United States Patent [19]

Jones

[11] 4,030,720

[45] June 21, 1977

[54] PAPER STACKER

[76] Inventor: Gary E. Jones, 103 Phillips Road, East Greenwich, R.I. 02818

[22] Filed: Feb. 17, 1976

[21] Appl. No.: 658,377

[52] U.S. Cl. ..... 270/61 F; 197/133 F
[51] Int. Cl.[2] ..... B65H 45/00
[58] Field of Search ..... 270/30–31, 270/61 F, 79; 197/133 F, 133 P

[56] References Cited

UNITED STATES PATENTS

| | | | |
|---|---|---|---|
| 3,363,895 | 1/1968 | Takashi | 270/61 F |
| 3,464,610 | 9/1969 | Koning | 270/61 F |
| 3,684,275 | 8/1972 | Schweitzer | 270/79 |

*Primary Examiner*—Edgar S. Burr
*Assistant Examiner*—A. Heinz
*Attorney, Agent, or Firm*—Clarence A. O'Brien; Harvey B. Jacobson

[57] ABSTRACT

A continuous web of perforated paper is withdrawn from a buffer zone and fed at a constant linear rate through an oscillating chute device unto a folded stack. The feeding and folding motions imparted to the web are synchronized through control over stepper motors respectively driving the paper feeding and folding devices. A pulse generator produces a common train of digital pulses that are fed to a pair of frequency dividers within which the pulses are divided into two trains of driving pulses at different pulse rates. The driving pulses are simultaneously fed to the stepper motors for operation at different rates during a paper stacking cycle initiated after the paper is detected at the bottom of the buffer zone by a sensor switch. The driving pulses are monitored to produce error signals whenever synchronization is lost or malfunction occurs.

10 Claims, 9 Drawing Figures

BIN SENSOR
INDICATORS
102
RESET
82
CYCLE CONTROL CIRCUITS
98
ERROR DETECTION CIRCUITS
100
74
POSITION SENSOR
56
96
92
PULSE FREQ. DIVIDER N÷K1
PAPER DRIVE MOTOR
COMMON PULSE TRAIN GENERATOR (N)
58
94
PULSE FREQ. DIVIDER N÷K2
FOLDING DRIVE MOTOR

+
HOLD
DRIVE
120
122

56
d
c
b
a
170
+V

+
HOLD
DRIVE
112 d
c
b
a
+V

PAPER STACKER

BACKGROUND OF THE INVENTION

This invention relates to the stacking of fan-folded webs of paper from a line printer or similar device.

A web of paper is usually fed from a printing mechanism for stacking in folded form. Various paper stacking devices have been devised to insure orderly folding and stacking of the paper after it is ejected from the printer. However, prior paper stacking apparatus of the foregoing type have not been satisfactorily reliable in regard to continuous synchronization of web feed and folding motions. It is, therefore, an important object of the present invention to provide a relatively simple, yet effectively reliable, synchronizing system for a fan-folded web stacker capable of handling all types of paper format with a minimum of operator intervention.

In accordance with the present invention, a fan-foled web from a high speed printer or the like is fed into a buffer zone or bin and when the paper reaches the bottom of the bin, a sensor detects the web to start a paper stacking cycle. During the paper stacking cycle, the paper web is withdrawn from the buffer zone by tractor feed devices, the paper being fed through an oscillating folder chute device by means of which the paper is folded as it is deposited onto a stack within a receiving bin. Since the paper web is folded at spaced positions within the receiving bin, the folding chute is oscillated through a fixed arc of 45°, for example, at a rate synchronized with the feeding motion of the web. The feeding and folding motions are controlled by two separate stepper motors utilizing a common source of pulses that are digitally divided by different factors in order to produce driving pulses at different pulse rates. The number of common pulses and the division factors are selected in accordance with the feeding velocity and paper dimensions in order to produce the correct motion relationships. This pulse dividing drive arrangement is such that any errors introduced are non-accumulative. Monitor circuits are utilized to provide error detection in the event of any malfunction or deviation from the synchronized relationships normally maintained.

These together with other objects and advantages which will become subsequently apparent reside in the details of construction and operation as more fully hereinafter described and claimed, reference being had to the accompanying drawings forming a part thereof, wherein like numerals refer to like parts throughout.

DETAILED DESCRIPTION OF THE INVENTION

Figure 1:
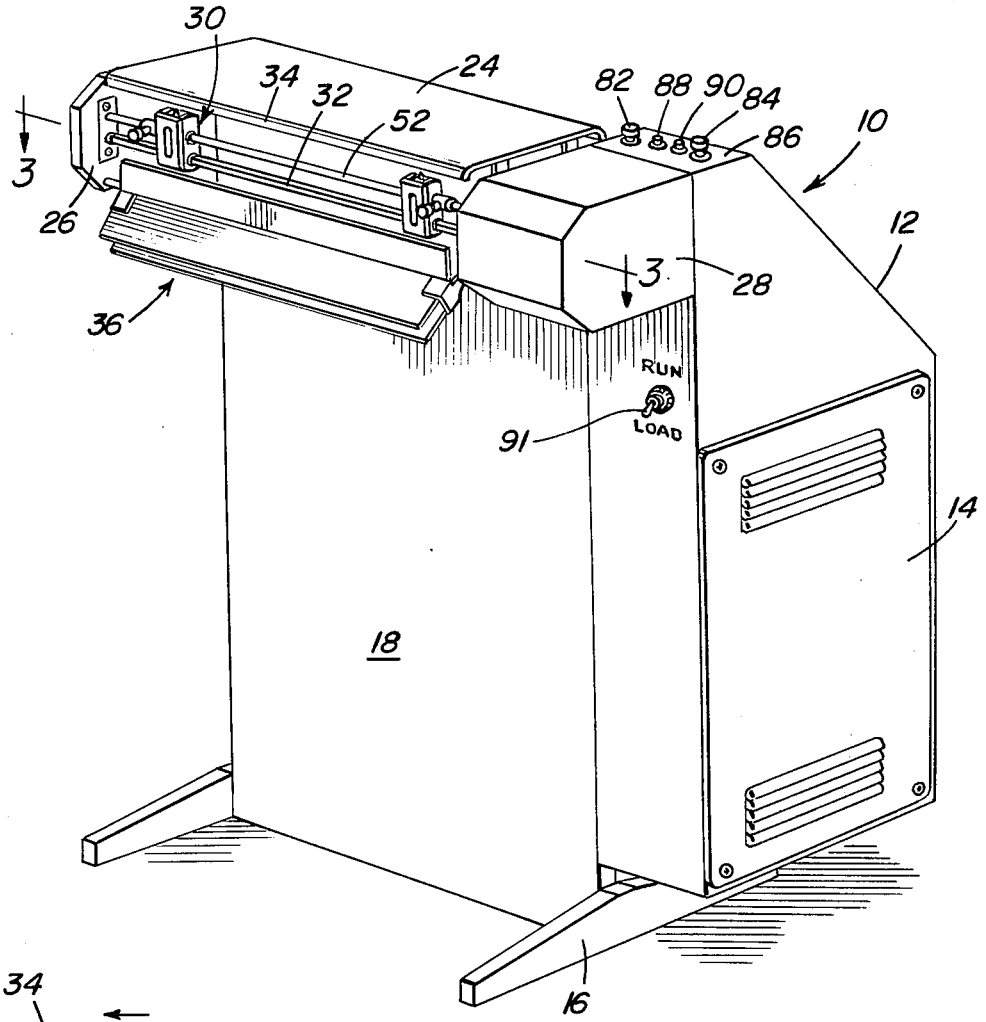
FIG. 1 is a perspective view illustrating a paper stacking apparatus constructed in accordance with the present invention.

FIG. 1 shows the paper stacker apparatus of the present invention generally referred to by reference numeral 10. The apparatus includes a vertically elongated cabinet generally denoted by reference numeral 12 having a ventilated side panel 14 providing access to enclosed control circuitry. The cabinet is supported by feet 16 that project forwardly from a front side panel 18 adapted to form the backing for a folded paper receiving bin 20 of a well known type as diagrammed in FIG. 2. The cabinet also encloses a web buffer pin 22 as diagrammed in FIG. 2 and has a top horizontal guide plate 24 fixed thereto. A support bracket 26 projects forwardly from the cabinet adjacent one end of the guide plate while a stepper motor housing section 28 projects forwardly from the cabinet adjacent the other end of the guide plate. A pair of paper advancing tractor devices 30 are supported by a square drive shaft 32 just below the forward curved edge portion 34 of the guide plate between the bracket 26 and the housing section 28. Also supported between the bracket 26 and housing section 28 just below the tractor devices is a paper folding chute device36.

Figure 3:
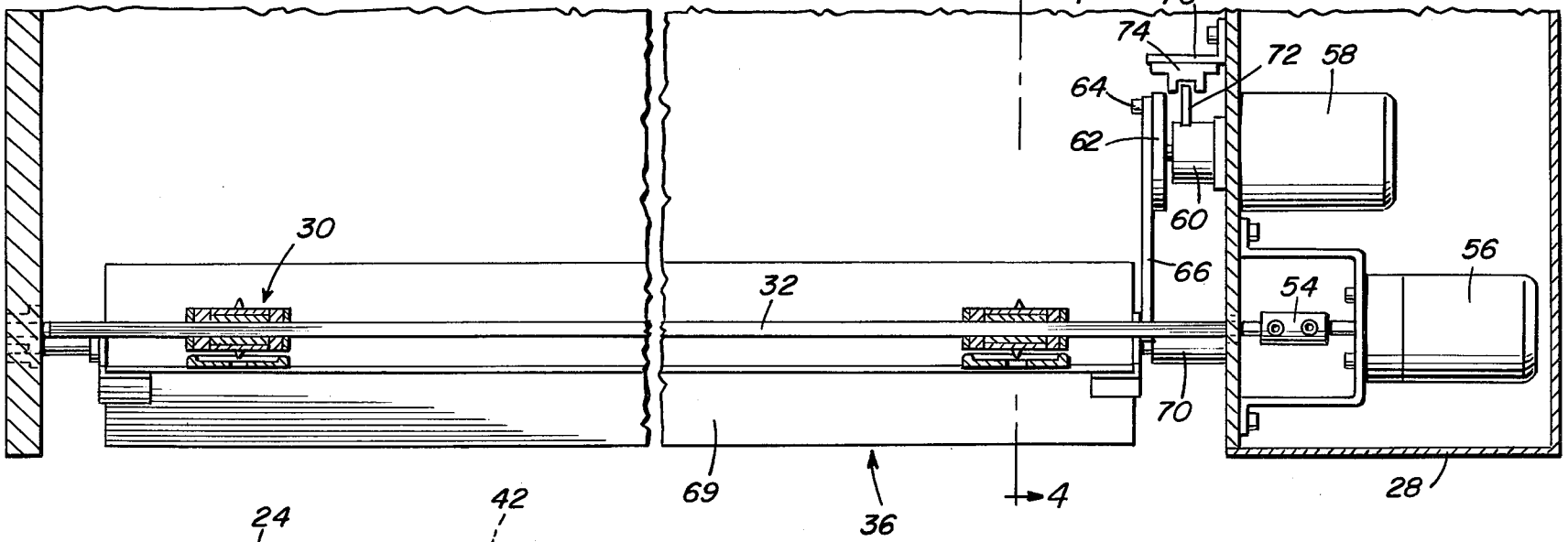
FIG. 3 is an enlarged partial sectional view taken substantially through a plane indicated by section line 3—3 in FIG. 1.
Figure 5:
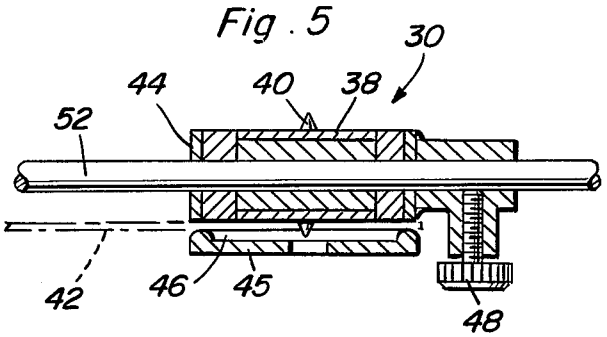
FIG. 5 is an enlarged partial sectional view taken substantially through a plane indicated by section line 5—5 in FIG. 4.
Figure 4:
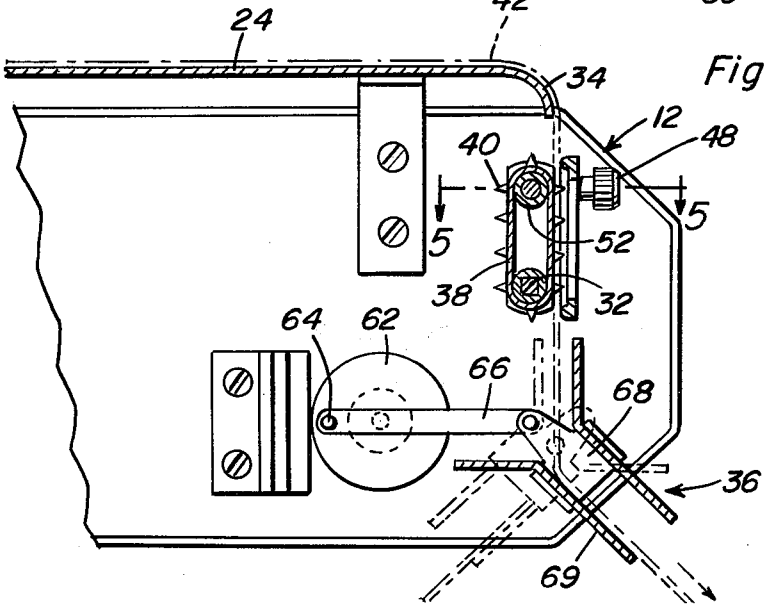
FIG. 4 is a partial sectional view taken substantially through a plane indicated by section line 4—4 in FIG. 3.

As more clearly seen in FIGS. 3, 4 and 5, each of the tractor devices 30 includes an endless belt 38 having pins 40 adapted to project through punched holes located on either side of the paper web 42 being fed to the stacker 10 from the external source such as a high speed printer (not shown) into the buffer bin 22 aforementioned. Each tractor 30 includes side plates 44 spaced from a guide plate 45 to form a guide slot 46 through which the punched edge portion of the paper web extends, the side plates being carried on a support shaft 52. The side plates 44 together with the drive belt 38 are held in an axially adjusted position along the drive and support shafts by means of a set screw clamp 48 securing the belt roller and positioning sleeve 50 to the support shaft 52 through which both tractor devices 30 are simultaneously driven. The drive shaft is connected by a flexible coupling 54 to a four-phase type of stepper motor 56 enclosed within the housing section 28 as shown in FIG. 3.

Also enclosed within the housing section 28 is a second four-phase stepper motor 58. The output shaft 60 of the motor 58 is connected to a crank disc 62 having a crank pin 64 connected to one end of a connecting rod 66, the other end of which is pivotally connected to an end spacer 68 interconnecting elongated blade elements 69 forming a guide chute for the paper web. The end spacer 68 pivotally supports the guide chute by means of a pivot shaft 70 as more clearly seen in FIG. 3. The guide chute is oscillated through an arc of 45° during each half revolution of the stepper motor 58. A signal is produced each revolution of the motor 58 by means of a pin 72 on shaft 60 interrupting the beam in a photo-electric, emitter sensor 74 mounted in operative relation on the housing section 28 by bracket 76.

Figure 2:
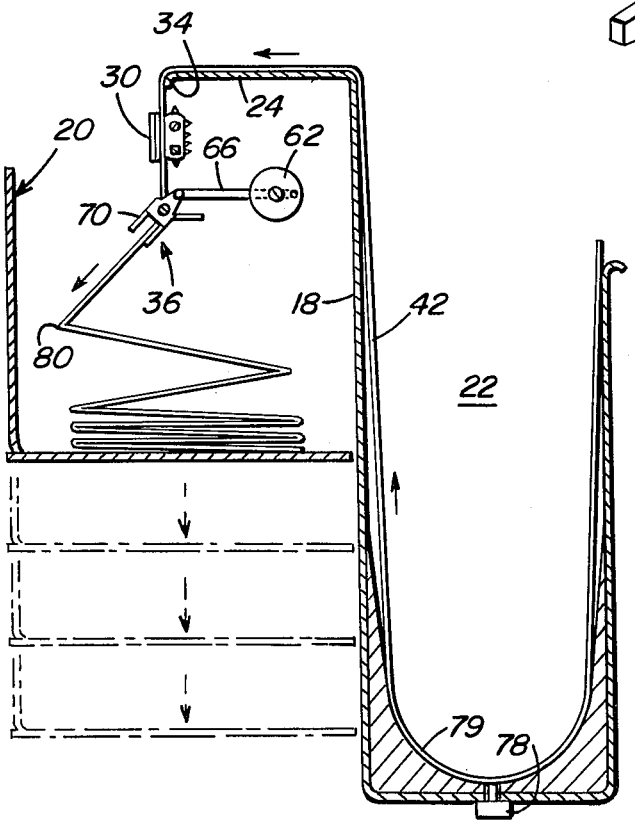
FIG. 2 is a schematic side sectional view of the apparatus shown in FIG. 1.

As diagrammatically shown in FIG. 2, the paper web 42 when fed into the buffer bin 22 engages a detector switch 78 in order to initiate a paper cycle when the paper reaches the curved bottom surface 79 of the bin.

Alternatively, a photo-electric sensor could be utilized to detect the paper on the bottom surface. During the paper cycle, the stepper motor 56 is pulsed to control the advancement of the paper web from the buffer bin 22 as a regulated velocity by means of the tractor devices 30. The stepper motor 58 pulsed in synchronized relation to motor 56 operates through folding device 36 to effect folding of the paper web along fold lines 80 and stacking of the folding web. The receiving bin 20 is lowered, as shown by dotted line in FIG. 2, as a function of the mass of the paper stack, to increase its stacking capacity. Control over the stacker apparatus by an operator is exercized by actuation of a reset button 82 and a start position button 84, said control buttons being mounted on a control panel surface 86 on either side of error indicator lamp 88 and ready indicator lamp 90 as shown in FIG. 1. A load switch 91 is also provided in order to disable the detector switch 78 for reasons to be discussed hereafter.

Figure 6:
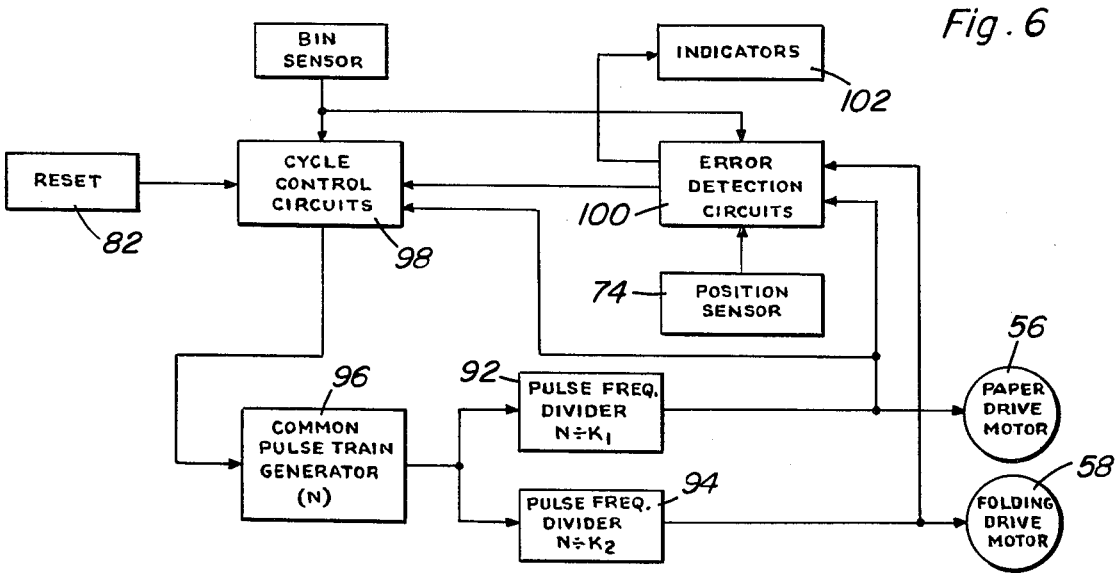
FIG. 6 is a schematic block diagram illustrating the system of the present invention.

FIG. 6 diagrammatically illustrates in simplified form the control system associated with the stacker apparatus. This system controls operation of the stepper motors 56 and 58 by supply of pulses at different pulse rates from pulse frequency dividers 92 and 94. To obtain synchronization in the operation of the motors, the pulses are derived from a common pulse train generator 96. The supply of pulses from the common pulse train generator to the motors is initiated in response to a signal from the bin sensor 78 as aforementioned through cycle control circuits 98 that also respond to signals from sensor 74 reflecting the position of the folder device 36, reset signals from reset control 82 and error signals from error detecting circuits 100 monitoring the motor drive pulses. The error signals are registered by the indicator lamp 88 through the indicator circuits 102.

Figure 7:
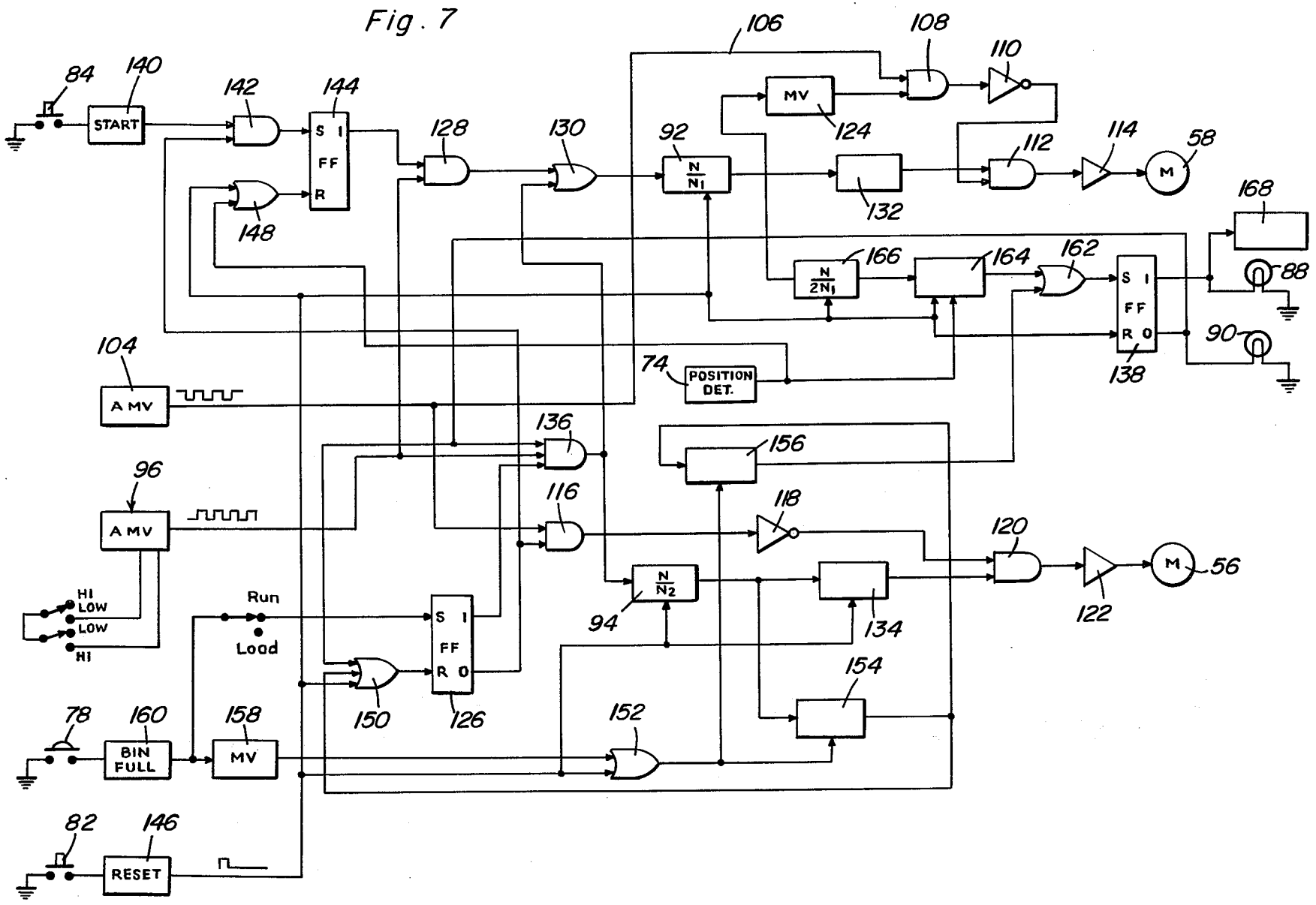
FIG. 7 is a logic circuit diagram depicting the control system of the present invention.

Referring now to FIG. 7, a logic circuit diagram corresponding to one embodiment of the invention is shown. The common pulse train generator 96 is in the form of a conventional, astable multivibrator which is always functional and logically gated to the stepper motors 56 and 58. The stepper motors are maintained nonfunctional by supply of a holding current thereto by gating of the output of a second continuously functional astable multivibrator 104. This holding current will not only lock each stepper motor on a particular phase but will be responsible for reducing the average current supplied to the motors in operating the system. The pulse output of the holding current generator 104 is fed through line 106 to one of the inputs of AND gate 108 connected by inverter 110 to one of the inputs of AND gate 112 through which driving pulses are fed to power amplifier 114 driving the folder motor 58. The output of holding current generator 104 is also fed to one of the inputs of AND gate 116, the output of which is connected by inverter 118 to one of the inputs of motor control gate 120 through which driving pulses are fed to power amplifier 122 for the paper advancing motor 56. A monostable multivibrator 124 connected to the other input of AND gate 108 allows holding current to be fed to the folder motor 58 at all times except when disabled by stepper motor commands from frequency divider 92. The gating of holding current from multivibrator 104 to the paper advancing motor 56 is controlled, on the other hand, by means of AND 116 in response to signals from a start flip-flop 126 connected to the other input of AND gate 116.

Figure 8:
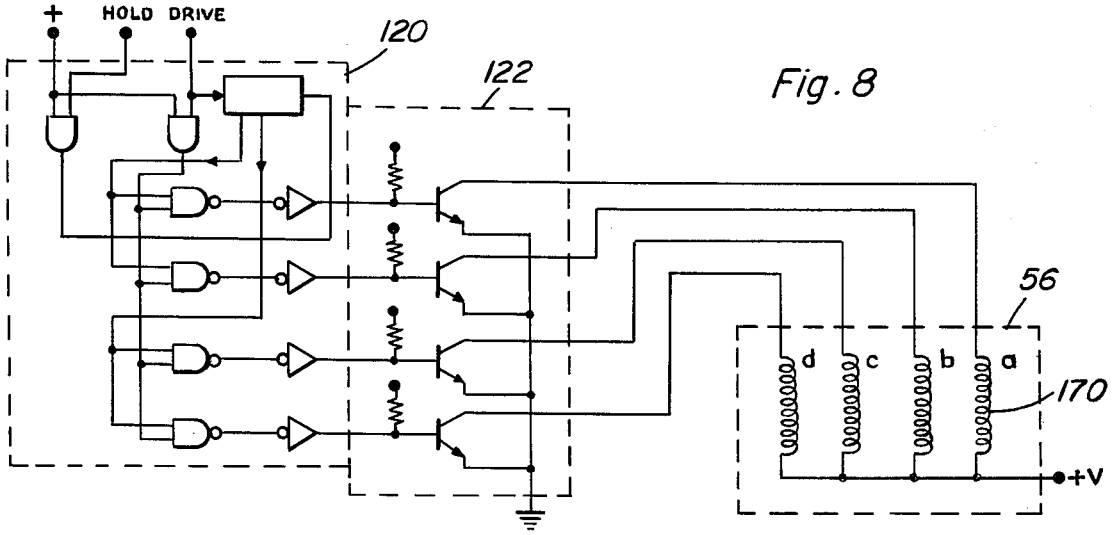
FIG. 8 is a circuit diagram illustrating one of the stepper motor control circuits.
Figure 9:
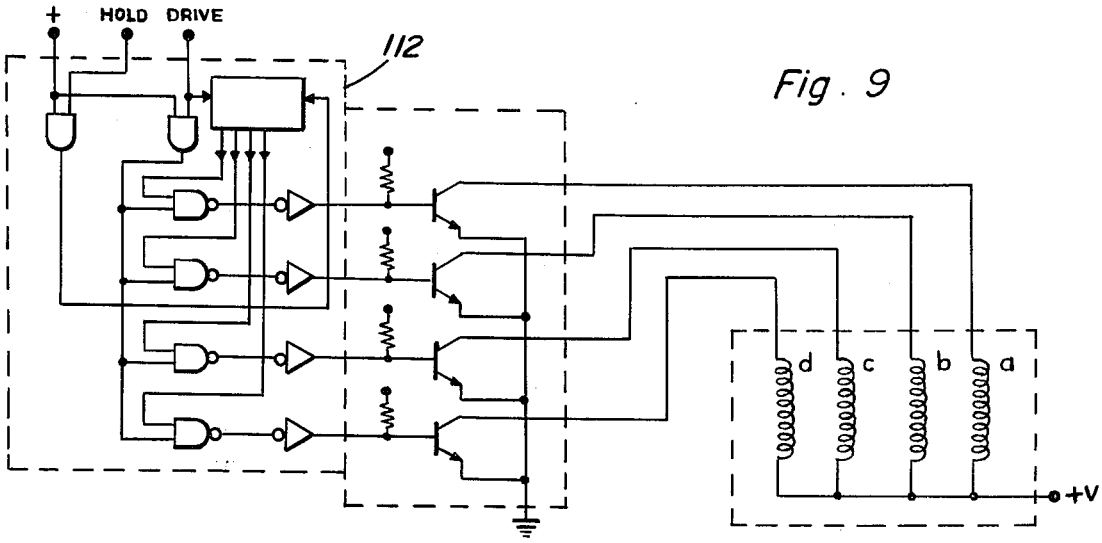
FIG. 9 is a circuit diagram illustrating the motor control circuit for the other stepper motor.

As hereinbefore indicated, the stepper motor 56 includes four phases denoted by the phase coils 170 in FIG. 8 to which driving current is supplied two at a time in sequence through AND gate 120. The AND gate 120 as shown is arranged to supply a reduced holding current to the last two of the pulsed phase coils. In the case of stepper motor 58, the AND gate 112 is arranged to supply holding current to the last pulsed phase coil 171 as shown in FIG. 9 whereas driving current is supplied to each of the four phase coils in sequence.

Referring once again to FIG. 7, the motor output pulses from the common pulse train generator 96 are fed along one path through AND gate 128 to the pulse frequency divider counter 92 through an OR gate 130. A pulse output from the counter 92 is fed to a four phase counter 132 through which low frequency driving pulses are fed to stepper motor 58 when passed by AND gate 112. A higher frequency driving pulse output from pulse frequency divider 94 is fed to the stepper motor 56 by a four phase motor pulse counter 134 when passed by the AND gate 120. The supply of pulses from the common pulse train to the frequency divider 94 is controlled by AND gate 136. The AND gate 136 also supplies through another path to frequency divider 92 through OR gate 130. The gating control of AND gate 136 over the pulse output of the common pulse train generator 96 connected to one of its three inputs, is derived from the buffer pin sensor 78 through flip-flop 126 and the error circuit flip-flop 138, said flip-flops being connected to the other two inputs of AND gate 136.

The bin 22 acts as reservoir into which the web 42 is fed and allows a non-uniform linear velocity to be buffered so that the stacker velocity will remain constant. The curved bottom surface 79 of the bin avoids stacking of the paper therein in favor of a tumbling motion to facilitate withdrawal of the web by the tractors 30 without tearing of the paper.

Upon closing of the start position switch 84, a folder device operating circuit 140 is activated to supply an output to one of the inputs of AND gate which is thereby gated under control of flip-flop 126 connected to the other input of AND gate 142. The output of AND gate 142 is thus operative through flip-flop 144 to control the gating of pulses from the common pulse train through the path established by AND gate 128. The flip-flop 144 is reset either by reset circuit 146 or flip-flop 126 through OR gate 148. The reset circuit 146 which is activated by closure of reset switch 82 also resets flip-flop 126 through OR gate 150 and resets frequency divider and motor pulse counters 94 and 134 in order to apply holding current to two of the phases of stepper motor 56. Also, through OR gate 152, counter 154 is jammed to a predetermined count and error detection counter 156 is reset. Reset of the latter counters is also effected through OR gate 152 when circuit 158 goes high upon closure of the buffer sensor switch 78. The detection circuit 160 activated by closure of switch 78 also sets the flip-flop 126 when the load switch 91 is in its run position as shown in FIG. 7. The circuit 158 is a conventional filter arrangement which includes a plurality of monostable multivibrators operative to generate a single pulse in response to the first transition of signal level from the detector 160. If the paper is not pulled out of contact with the buffer sensor 78 during the ensuing paper stacking cycle, there is no signal level transition and the output of circuit 158 remains low. The load switch 91 when displaced to its load position prevents setting of the flip-flop 126 in order to allow initial positioning of the chute device 36 by closure of the start switch 84 even though the bin sensor switch 78 is held closed by paper because of some malfunction resulting in accumulation of too much paper in the bin 22.

The driving pulse output of the pulse frequency divider 94 is monitored by counter 154 so as to reset flip-flop 126 through OR gate 150 when a predetermined number of driving pulses are counted to complete a cycle. At the same time, the output of counter 154 is applied to error detection circuit 156 which produces an error signal if it is not previously reset through OR gate 152. Any error signal from detector 156 sets flip-flop 138 through OR gate 162. The flip-flop 138 may alternatively be set by an output from up counter 164 indicating that a chute error has occurred. The counter 164 counts the driving pulses from pulse frequency divider 92 being monitored by frequency dividing counter 166. If the output of detector 74 is not coordinated through flip-flop 138 to operate alarm circuits 168 and the error indicator lamp 88. The flip-flop 138 in its other state operates the ready lamp 90.

A reset cycle is initiated when reset switch 82 is closed to generate a positive reset pulse in circuit 146 to reset the start flip-flop 126 through OR gate 150. This allows holding current to be passed by AND gate 116 inverted and applied to AND gate 120. The reset pulse also jams motor pulse counter 134 so that AND gate 120 applies holding current to two of the phases of the stepper motor 56. At the same time, multivibrator 124 is operative to maintain holding current on a single phase of stepper motor 58 since all motor driving pulse paths are disabled. All counters are also jammed to correct counts and the flip-flops, error circuits and folder position circuits reset.

To initiate a positioning cycle, the start position switch 84 is closed in order to move the paper folder device to a predetermined position for locating the paper and to insure synchronization between the folding action and paper web velocity. During the folder position cycle, the output of circuit 140 and the high state of flip-flop 126, allows AND GATE 142 to set positioning flip-flop 144. The output drive pulses from multivibrator 96 are then fed by AND gate 128 under control of the circuit formed by flip-flop 144 to divider 92 while AND gate 136 is inhibited by previous reset of start flip-flop 126 to prevent supply of pulses to divider 92 along the path formed externally of the position control circuit. The divider 92 is a conventional programmable up/down counter utilized in a down count mode. Its frequency division is a function of the folding motion and fold spacing. Accordingly, the stepper motor 58 is driven by pulses at a lower rate than those of the common pulse train. These motor driving pulses are continuously generated until detector 74 generates an output resetting the positioning flip-flop 138 and terminates drive pulses to motor 58 by resetting flip-flop 144. Holding current then locks motor 58 until the next driving pulse occurs.

When the paper web reaches the bottom of the buffer bin 22, it is detected by the bin sensor 78 to generate a start pulse in circuit 160 and initiate a paper stacking cycle by setting the start flip-flop 126. When set, the flip-flop 126 allows the supply of drive pulses from AND gate 136 to both-stepper motors 56 and 58 at different pulse rates. The drive pulses supplied to the paper advancing motor 56 at the higher pulse rate are monitored by count detector 154 so that when a pre-set count is reached, a reset pulse is generated to reset the start flip-flop 126 and terminate the paper stacking cycle. The drive pulses are supplied to the folder operating motor 58 at the lower pulse rate as aforementioned during the paper stacking cycle.

A paper feed error is detected when the circuit 158 fails to generate an output after the start flip-flop remains set following a predetermined number of reset pulses such as four. In a normal paper stacking cycle, the count detector 154 generates an output as a function of a pre-set number of paper advancing drive pulses to terminate the cycle by reset of flip-flop 126. However, flip-flop 126 can only be reset if the output of bin detector 160 is low. In the event the paper web tears, or the motor 56 is non-functional or the associated drive circuits are inoperative, the bin sensor switch 78 remains closed even though a single reset pulse is generated by detector 154 so that the flip-flop does not latch in the reset state. This error condition remains for a pre-set number of paper stacking cycles before it is detected. Toward that end, the end cycle pulses from the count detector 154 are fed to cycle error detector 156 which generates an error signal when a predetermined number of end cycle pulses occur without any output from circuit 158.

In order to detect any errors in synchronization between the oscillating motion of the folding device 36 and the stepped rotation of its drive motor 58, the motor drive pulses from divider 92 are further divided in half by divider 166 and fed to counter 164 which is a conventional programmable up/down counter arranged to reach a full count of 15. However, an output from the folder position detector 74 executes a pre-set count to prevent the counter 164 from reaching a full count. If the output from detector 74 is missing, the counter 164 is not pre-set and an error signal is generated. This error signal resets the start flip-flop 126, inhibits supply of drive pulses to the motors, and activates the alarms 88 and 168.

In an actual embodiment of the invention, there are 96 pulses in the common pulse train corresponding to a press length or distance between paper folds of 10 inches. These pulses are divided by a factor of 5 to pulse the motor 56 in order to advance the paper web 2½ inches per revolution of the motor 56 being stepped 24 times each revolution at a step angle of 15° per step. The folder device 36 has an angular motion of 45° each half revolution of its motor 58 which is also stepped 24 times per revolution. The common pulse train is divided by a factor of 40 to pulse the motor 58. Deviations from the ideal motion relationships as given by the foregoing dimensional examples will, of course, occur due to boundary conditions but because of the digital division of a common pulse train in order to pulse the two stepper drive motors, actual motion relationship approach the theoretical ideal.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a sheet folding and stacking apparatus having a web feeding device for withdrawing a continuous web from a buffer zone and a web folding device for depositing the web onto a folded stack, a synchronizing control system for regulating operation of a pair of drive motors drivingly connected to the web feeding and folding devices, respectively, comprising means for generating a common train of electrical pulses at a fixed pulse rate, digital divider means connected to the generating means for producing two trains of driving pulses of different pulse rates, and drive means for respectively supplying the driving pulses at the different pulse rates to the drive motors to effect operation of the web feeding and folding devices in synchronized relation to each other.

2. The combination of claim 1 wherein said folding device includes a pivotally displaceable web chute through which the web is guidingly displaced by the feeding device and link means connecting one of the drive motors to the chute for pivotal displacement thereof, and position circuit means connected to the drive means for effecting displacement of the folding device to a predetermined position from which an operational cycle begins.

3. The combination of claim 2 including sensor means for detecting the presence of the web within the buffer zone, and means connected to the sensor means for preventing initiation of said operational cycle until the web is detected.

4. The combination of claim 2 wherein said driving pulses are supplied to one of the motors alternatively along different pulse paths respectively extending through the position circuit means and externally of the position circuit means.

5. The combination of claim 1 wherein said web is advanced at a constant linear rate by the feeding device while guided through the folding device oscillated through a fixed arc by one of the drive motors.

6. In combination with a sheet folding and stacking apparatus having a web feeding device for withdrawing a continuous web from a buffer zone and a web folding device for depositing the web onto a folded stack, a synchronizing control system for regulating operation of a pair of drive motors drivingly connected to the web feeding and folding devices, respectively, comprising means for generating a common train of electrical pulses at a fixed pulse rate, digital divider means connected to the generating means for producing two trains of driving pulses of different pulse rates, drive means for respectively supplying the driving pulses at the different pulse rates to the drive motors to effect operation of the web feeding and folding devices in synchronized relation to each other, position circuit means connected to the drive means for effecting displacement of the folding device to a predetermined position from which an operational cycle begins, sensor means for detecting the presence of the web within the buffer zone, means connected to the sensor means for preventing initiation of said operational cycle until the web is detected, and error detecting means connected to the sensor means and monitoring said driving pulses for producing an error signal when said operation of the feeding and folding devices is no longer synchronized.

7. The combination of claim 6 wherein said error detecting means includes means for producing said error signal when a predetermined number of said operational cycles are completed during continuous detection of the web within the buffer zone.

8. The combination of claim 7 wherein each of said drive motors is of the plural phase step type, and means for supplying holding current to at least one of the motors when said supply of driving pulses is interrupted.

9. In combination with a sheet folding and stacking apparatus having a web feeding device for withdrawing a continuous web from a buffer zone and a web folding device for depositing the web onto a folded stack, a synchronizing control system for regulating operation of a pair of drive motors drivingly connected to the web feeding and folding devices, respectively, comprising means for generating a common train of electrical pulses at a fixed pulse rate, digital divider means connected to the generating means for producing two trains of driving pulses of different pulse rates, drive means for respectively supplying the driving pulses at the different pulse rates to the drive motors to effect operation of the web feeding and folding devices in synchronized relation to each other, position circuit means connected to the drive means for effecting displacement of the folding device to a predetermined position from which an operational cycle begins, sensor means for detecting the presence of the web within the buffer zone, means connected to the sensor means for preventing initiation of said operational cycle until the web is detected, and error detecting means for producing an error signal when a predetermined number of said operational cycles are completed during continuous detection of the web within the buffer zone.

10. In combination with a sheet folding and stacking apparatus having a web feeding device for withdrawing a continuous web from a buffer zone and a web folding device for depositing the web onto a folded stack, a synchronizing control system for regulating operation of a pair of drive motors drivingly connected to the web feeding and folding devices, respectively, comprising means for generating a common train of electrical pulses at a fixed pulse rate, digital divider means connected to the generating means for producing two trains of driving pulses of different pulse rates, drive means for respectively supplying the driving pulses at the different pulse rates to the drive motors to effect operation of the web feeding and folding devices in synchronized relation to each other, each of the said drive motors being of the plural phase step type, and means for supplying holding current to at least one of the motors when said supply of driving pulses is interrupted.

* * * * *